US007404763B2

(12) United States Patent
Malone et al.

(10) Patent No.: US 7,404,763 B2
(45) Date of Patent: Jul. 29, 2008

(54) MODIFIED PLAYING CARDS AND METHOD OF USE

(76) Inventors: Peter T. Malone, 8837 Stingray Ct., Las Vegas, NV (US) 89147; Jerome K. Roed, 3078 Conquista Ct., Las Vegas, NV (US) 89121

( * ) Notice: Subject to any disclaimer, the term of this patent is extended or adjusted under 35 U.S.C. 154(b) by 295 days.

(21) Appl. No.: 11/347,746

(22) Filed: Feb. 3, 2006

(65) Prior Publication Data

US 2006/0125181 A1 Jun. 15, 2006

Related U.S. Application Data

(63) Continuation of application No. 10/818,982, filed on Apr. 5, 2004, now abandoned.

(51) Int. Cl.
*A63F 1/00* (2006.01)
*A63F 13/00* (2006.01)

(52) U.S. Cl. ..... 463/13; 273/292; 273/306; 273/304; D21/378; D21/376

(58) Field of Classification Search ..... 273/306, 273/303, 304, 305, 307, 292; D21/378, 377, D21/376, 379, 381, 383, 384, 380; 463/12, 463/13

See application file for complete search history.

(56) References Cited

U.S. PATENT DOCUMENTS 848,542 A * 3/1907 Ferris ..... 273/306
1,012,574 A 12/1911 Adams
1,076,307 A 10/1913 Nicholson
1,401,001 A * 12/1921 Smiley ..... 273/306
4,219,197 A 8/1980 Acuff
4,333,656 A 6/1982 Sommer
4,402,513 A 9/1983 Head
4,877,255 A 10/1989 von Braunhut
5,098,107 A 3/1992 Boylan et al.
5,417,432 A 5/1995 Dwyer
5,653,444 A 8/1997 Dahl
5,799,947 A * 9/1998 Spector ..... 273/304

OTHER PUBLICATIONS

Tan Stix 21, Ten Stix, Inc., World Gaming Congress and Expo, Oct. 1997 (1 page).

* cited by examiner

*Primary Examiner*—Benjamin H Layno
(74) *Attorney, Agent, or Firm*—Rob L. Phillips; Greenberg Traurig

(57) ABSTRACT

A deck of modified playing cards enhances traditional wagering card games. In a first example, traditional card ranks are replaced with letters. For example, each Ten, Jack, Queen, King and Ace of one or more suits in a deck of playing cards is replaced with the letters "V", "E", "G", "A", and "S", respectively. In another example, all Jacks are replaced with the numeral "11" to facilitate a 7/11 bonus game. In another example, all Kings are replaced with the number "13" and all Sevens are replaced with the letter "L" and word "Lucky." In yet another example, pre-established cards are replaced with logos such that the logo card in a final card hand acts as bonus card or may act as a wild card. In such an arrangement, casino logos can be used to promote the casino and its amenities. In one version, awards include comps to businesses represented by the logo.

18 Claims, 3 Drawing Sheets

MODIFIED PLAYING CARDS AND METHOD OF USE

CROSS REFERENCE TO RELATED APPLICATIONS

This application is a continuation of application Ser. No. 10/818,982 filed Apr. 5, 2004 now abandoned.

FIELD OF THE INVENTION

The present invention relates to playing cards. More particularly, modified playing cards for use in live games and games facilitated by electronic gaming devices.

BACKGROUND

Traditional playing cards have been in existence for centuries. A traditional deck of playing cards includes four suits, namely clubs, diamonds, spades and hearts. Each suit comprises an Ace, Two, Three, Four, Five, Six, Seven, Eight, Nine, Ten, Jack, Queen and King for a total deck of 52 cards.

Traditional cards have facilitated many games of chance including Poker, Blackjack, Cribbage, Pinochle, etc. In each instance, the rank and suit of the card is depicted on its face. While it is understood that new games of chance utilizing traditional cards may be developed, the ability to create corresponding new and unique game enhancements is quite limited. That is, traditional cards no longer provide a great deal of versatility.

The ability to provide versatility is more important given the proliferation of electronic gaming devices, namely video poker machines. Indeed, video poker machines are now more popular than live games of chance. Correspondingly, there is a need for modified playing cards which benefit both live games of chance and wagering games facilitated by electronic gaming devices.

SUMMARY

Accordingly, a first embodiment of the present invention comprises a modified deck of cards wherein card ranks are replaced with letters. For example, each Ten, Jack, Queen, King and Ace in a deck of playing cards is replaced with the letters "V", "E", "G", "A", and "S", respectively. Each of the letter cards also include suits.

In another embodiment, all Jacks are replaced with the numeral "11" to facilitate a 7/11 bonus. Similarly, an enhanced royal flush comprises a 7, 11, Queen, King and Ace. The traditional royal flush (i.e., 10, Jack, Queen, King and Ace) may be paid at a reduced rate.

In another embodiment, all Kings are replaced with the number "13" and all Sevens are replaced with the letter "L" and word "Lucky." Other embodiments comprise replacing all cards with letters and/or numbers to facilitate unique objectives.

In yet another embodiment, pre-established cards are replaced with logos such that the logo card in a final card hand acts as bonus card or may act as a wild card. In one such embodiment, casino logos are used to promote the casino offering the games of chance. As described in more detail below, the logos may be used to award player comps as well.

The use of the modified cards disclosed herein provides a means for enhancing traditional card games and personalizing games for individual casinos and related gaming venues.

DETAILED DESCRIPTION

While both live games (e.g., Blackjack) and wagering games facilitated by electronic gaming devices (e.g., video poker) may utilize the modified cards of the present invention, for the sake of brevity, gaming devices, more particularly gaming devices facilitating video poker, are relied upon throughout the detailed description. Traditional video poker comprises a player receiving five cards on a display of a video poker machine. The player then elects, via a player interface, which cards to hold and fold. Folded cards are replaced with remaining cards in the deck. Players are then paid based on the strength of the player's final poker hand.

Video poker machines are controlled by processors in communication with a random number generator, memory device, display and player interfaces. The operation of video poker machines is well known to those skilled in the art and need not be overly described herein.

Figure 1:
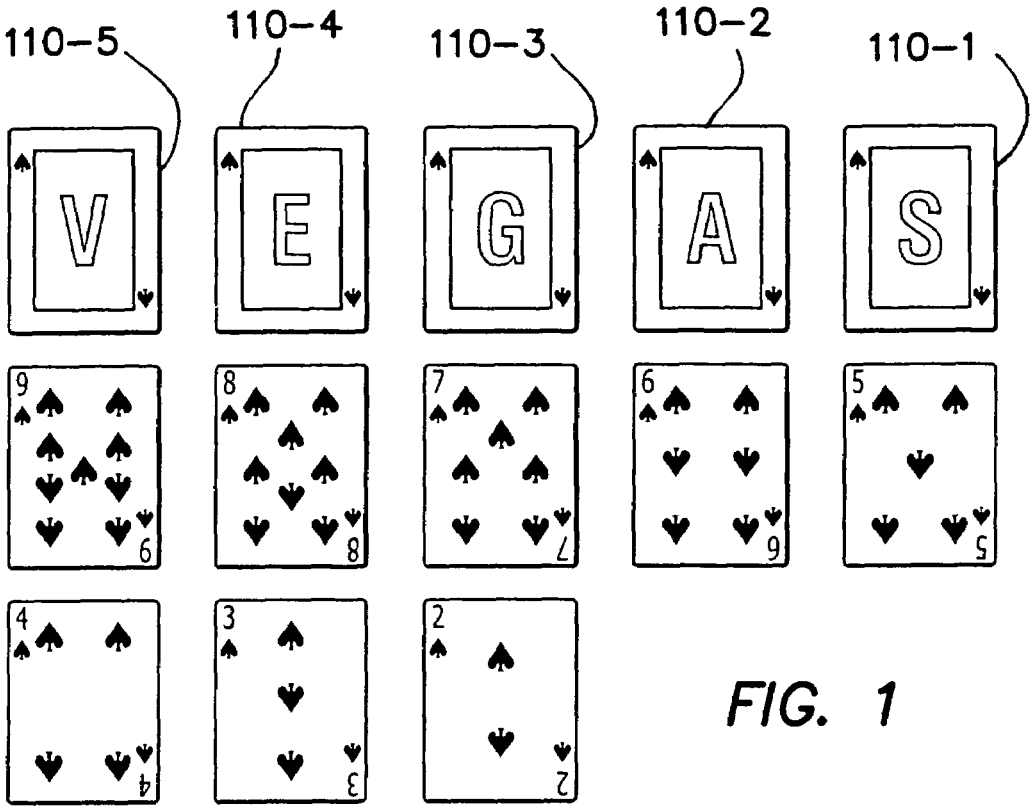
FIG. 1 shows a modified portion of a deck of cards wherein letters replace royal flush cards.

Reference is now made to the figures wherein like parts are referred to by like numerals throughout. FIG. 1 illustrates a modified portion of a deck of cards 100, wherein the royal flush cards are replaced with the letters "V", "E", "G", "A" and "S" 110-1 through 110-5. While spades 120 are shown, any of the cards of the four suits in the deck may be similarly modified. Indeed, each of the selected cards of the four suits may be modified in a single deck simultaneously.

The royal flush is the highest achievable hand in standard video poker. There are four possible royal flushes in a standard deck of playing cards. That is, each suit comprises one royal flush. In the VEGAS arrangement of FIG. 1, players attempt to obtain the five letters in sequential order or random order to win pre-established payouts. Should only one suit be modified, obtaining the five letters in any order can be subject to a large award as cards in only one suit (i.e., five cards) have the letters. Moreover, obtaining the letters in a sequential (i.e., VEGAS) or reverse sequential order (i.e., SAGEV) can have a very large award since there is only one way to achieve the hands.

Figure 2:
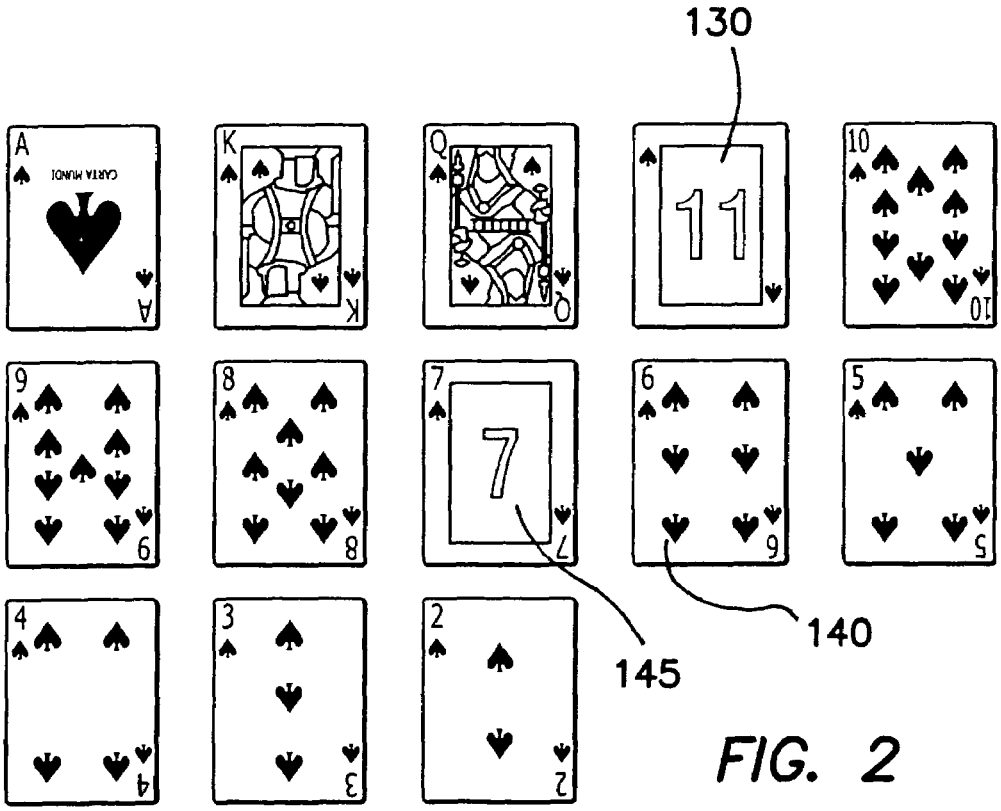
FIG. 2 shows a modified portion of a deck of cards wherein Jacks are replaced by the numeral "11"

Now referring to FIG. 2, the four Jacks in the deck are replaced with numerals "11" 130. In addition, Sevens are modified by replacing the large suit icons or pips 140 with a single large numeral "7" 145. Such a modified deck facilitates the play of new interesting games. For example, 7-11 royal flush poker creates a new royal flush poker hand comprising the 7, 11, Queen, King and Ace. The traditional royal flush (i.e., 10, Jack, Queen, King and Ace) may still pay the player, but in a lower amount. In another example, 7-11 full house poker pays players a bonus for obtaining a full house comprising 7-11 only (e.g., 7-7-11-11-11 or 11-11-11-7-7). Based on the dice game of craps, 7-11 are popular numbers in gaming circles and serve to enhance the traditional game of video poker.

Figure 3:
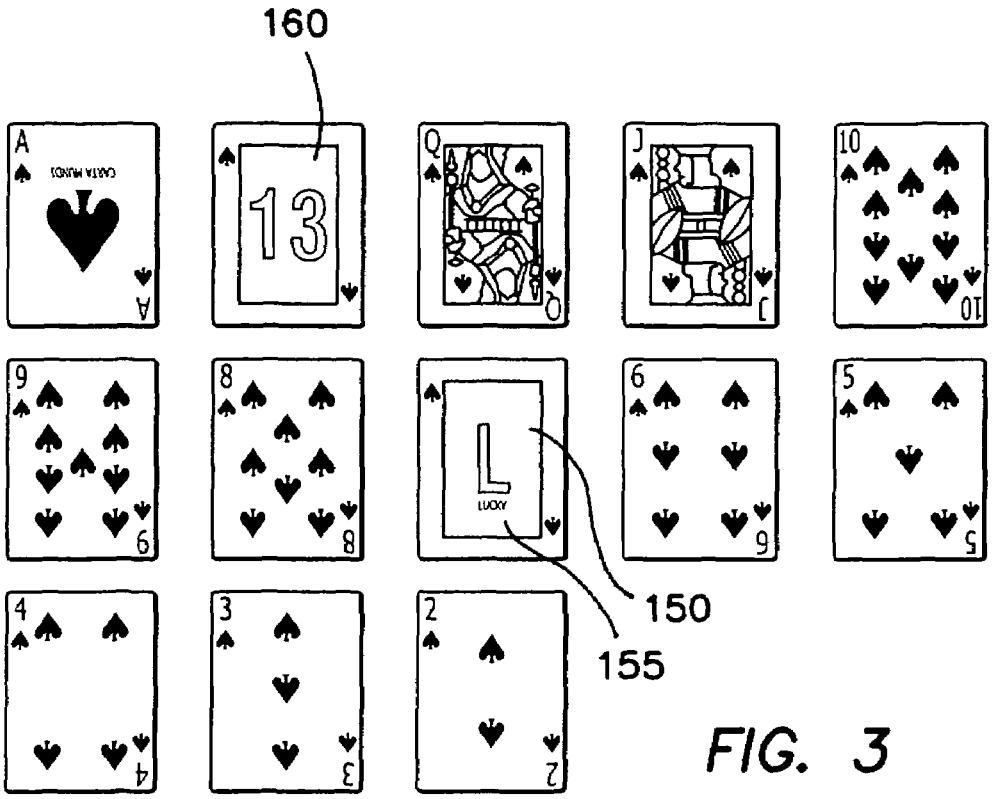
FIG. 3 shows a modified portion of a deck of cards wherein Sevens are replaced with the letter "L" and Kings are replaced with the numeral "13"

In another embodiment, shown in FIG. 3, Sevens are replaced with the letter "L" 150 and word "LUCKY" 155 and Kings are replaced with the numeral "13" 160. This arrangement facilitates a bonus award for final hands comprising four 13s and a designated LUCKY card (i.e., LUCKY 13). Other bonus hands are also conceivable using the combination of the LUCKY cards and 13s.

Figure 4:
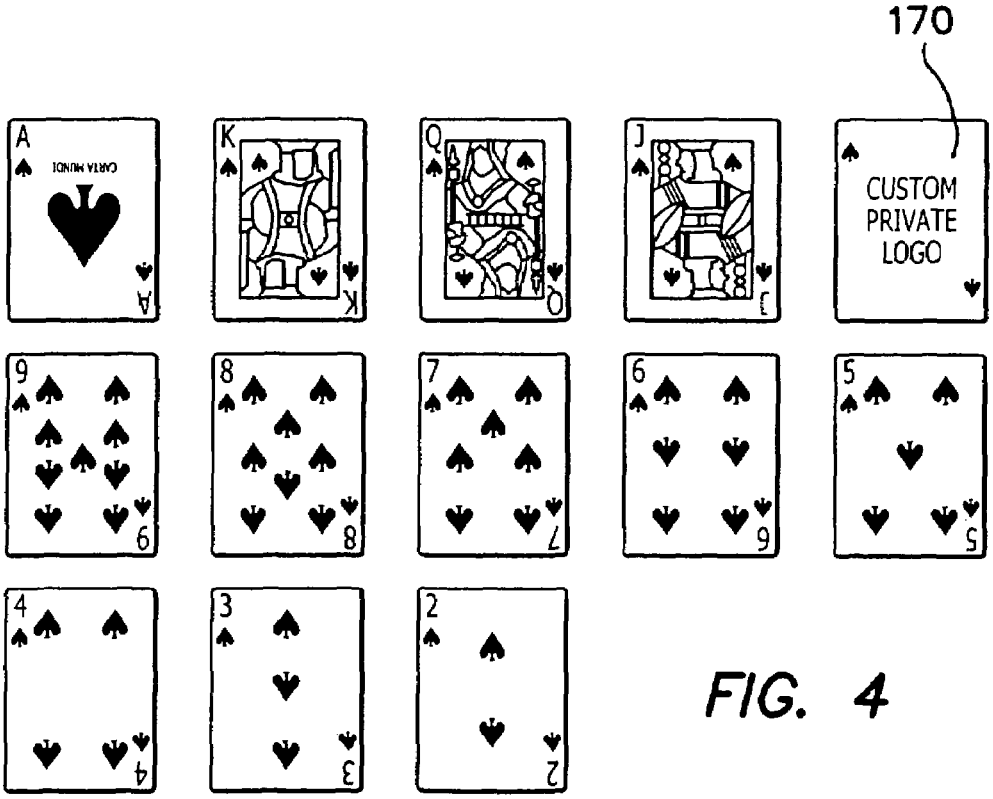
FIG. 4 shows a modified portion of a deck of cards wherein Tens are replaced with logos.

Yet another embodiment, utilizing logo cards, is shown in FIG. 4. The logo cards may be used as replacement cards for any cards in the deck. In one example, the Tens from a Blackjack deck of cards are replaced with logos 170. In one bonus scheme, players receive a bonus payout when receiving a two card Blackjack wherein one card is the logo card (i.e., the Ten). So, an Ace and logo card results in a bonus award above and beyond the traditional Blackjack payout. In a video poker example, logos 170 replace Twos and act as wild cards.

The benefits of the logo cards include enhancing old games of chance and provide a mechanism for advertising. In one approach, the casino offering the game of chance places its logo on the cards simulated on each and every video poker machine on the casino floor. The casino may also place on the cards logos which represent restaurants, shops and related businesses within the casino. Then, bonus awards can include free dinners and/or merchandise (i.e., comps) from the business represented by the logo. A myriad of different promotional concepts are possible with the logo cards. For example, having one or more logo cards may provide the player with a steak dinner or free movie tickets.

Figure 5:
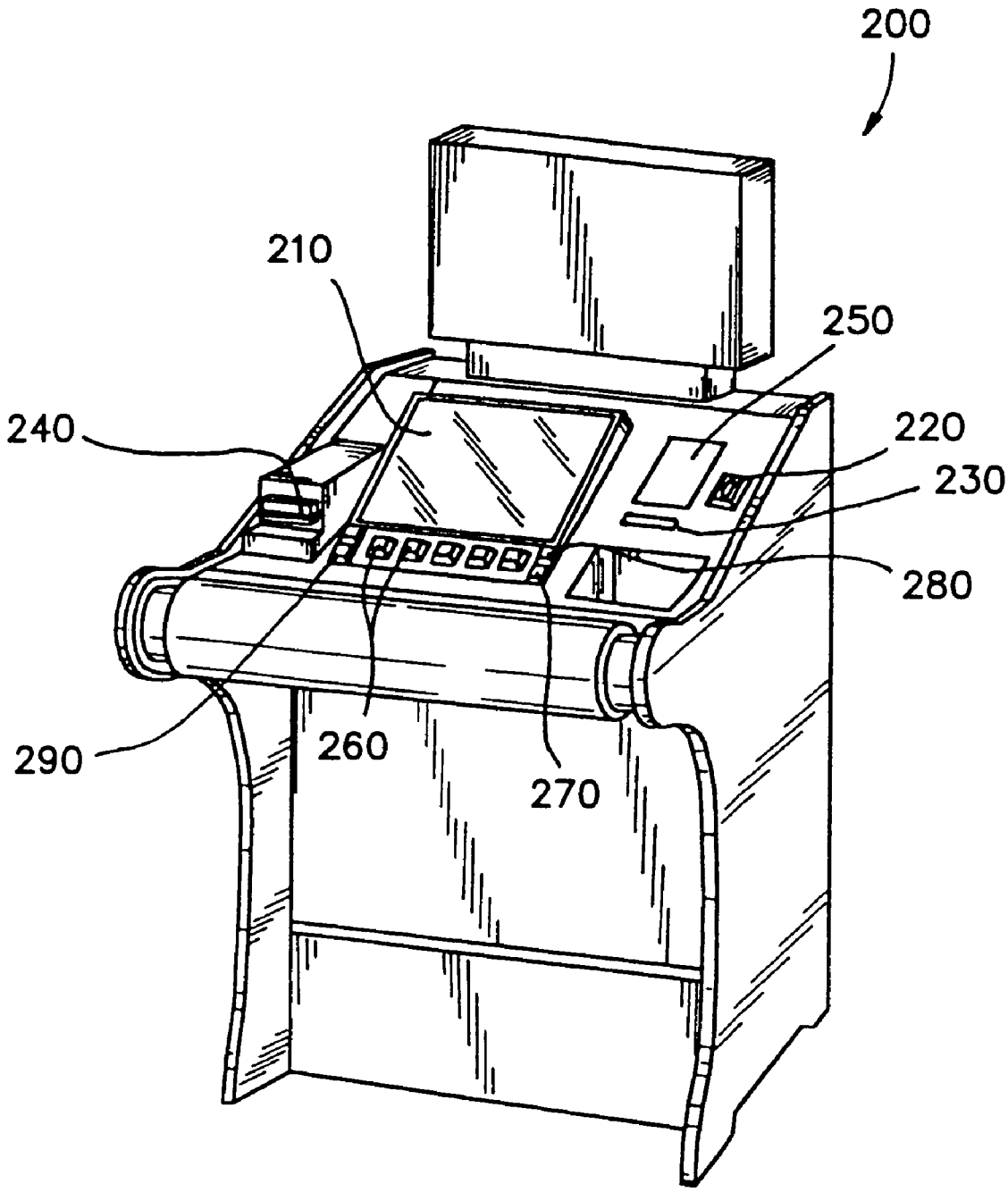
FIG. 5 shows a gaming device which may facilitate electronic games of chance.

Now referring to FIG. 5, an electronic gaming device 200 of the type which may facilitate the embodiments of the present invention is shown. The general external features of the gaming device 200, include a display 210, coin slot 220, a bill reader 230, a card reader 240 and a credit display 250. The gaming device 200 also includes several player buttons which act as interfaces between the player and the machine processor. Player buttons include hold/discard buttons 260, a one coin wager button 270, a maximum coin wager button 280 and a deal button 290. While not shown, the device 200 may also incorporate a ticket dispenser for printing tickets for redemption at a cashier window. Such cashless systems are becoming increasingly popular in most gaming jurisdictions. It is noted that any of the functions facilitated by the gaming machine buttons 260-300 can be accomplished by a display employing touchscreen technology.

The operation of electronic gaming devices, including slot machines and video poker machines, is well known in the industry so that the minute details are not set forth herein. In general terms, slot machines and video poker machines are controlled by processors including, or in communication with, a random number generator. The random number generator generates the machines=outcomes. A display in communication with the processor provides visual information to players.

Although the invention has been described in detail with reference to several embodiments, additional variations and modifications exist within the scope and spirit of the invention as described and defined in the following claims.

We claim:

1. A method of conducting a poker card game comprising:

providing a deck consisting of fifty-two cards formed by replacing one or more pre-established cards from a deck of conventional playing cards having fifty-two cards depicting heart suits, diamond suits, spade suits and club suits with each suit including thirteen cards comprising ranks from two through ace, wherein the conventional playing cards depict a card rank and a number of pips matching the depicted card rank or a graphical representation corresponding to a face card rank, with alternative cards each alternative card consisting of a suit, and logo or non-ranking letter, each of said alternative cards having no card rank or graphical representation of a face card rank represented thereon, wherein the alternative cards may take on multiple ranks selected from the ranks of the conventional cards the alternative cards replaced;

accepting player wagers or bets;

providing means for a player to participate in a card game utilizing randomly distributed cards from the deck of fifty-two cards, including the alternative cards, wherein rules of the card game comprise:

a. providing a player with a first set of cards from the deck of cards;

b. allowing said player to hold or discard each card from the first set of cards;

c. replacing any discards with replacement cards from the deck of cards; and d. providing a payout or award based on a strength of a final poker hand in combination with any alternative cards used to form said final poker hand.

2. The method of claim 1 further comprising providing the alternative cards with a casino logo and replacing conventional cards having a rank of ace, king, queen, jack and ten, respectively, of a particular suit.

3. The method of claim 2 further comprising allowing each of the alternative cards to assume the rank of ace, king, queen, jack or ten, wherein each rank is used once only.

4. The method of claim 1 facilitated by an electronic gaming machine.

5. The method of claim 1 facilitated by a live gaming table.

6. A method of conducting a video poker game comprising:

accepting a player wager;

displaying five random cards from a group consisting of fifty-two cards formed by replacing one or more cards from a deck of conventional playing cards having fifty-two cards depicting heart suits, diamond suits, spade suits and club suits with each suit including thirteen cards comprising ranks from two through ace, wherein the conventional playing cards depict a card rank and a number of pips matching the depicted card rank or a graphical representation corresponding to a face card rank, with alternative cards each alternative card consisting of a suit, and logo or non-ranking letter, each of said alternative cards having no depicted card rank or graphical representation of a face card rank, wherein the alternative cards may take on multiple ranks selected from the ranks of the conventional cards the alternative cards replaced;

providing means for the player to hold or fold each of the five cards;

replacing any folded cards with new cards from cards remaining in the group of fifty-two cards, including the alternative cards; and providing a player a payout or award based on a strength of a final poker hand in combination with any alternative cards used to form said final poker hand.

7. The method of claim 6 further comprising replacing five cards from the deck of conventional cards with the alternative cards.

8. The method of claim 7 further comprising replacing an ace, king, queen, jack and ten of the same suit with alternative cards.

9. The method of claim 6 further comprising paying a bonus to the player in response to the player's final hand including one or more alternative cards.

10. The method of claim 6 further comprising incorporating a casino logo on the alternative cards.

11. The method of claim 6 facilitated by an electronic gaming machine.

12. The method of claim 6 facilitated by a live gaming table.

13. A method of conducting a video poker game comprising:

accepting a player wager;

displaying five random cards from a group consisting of fifty-two cards formed by forty-seven unique, conventional playing cards, wherein the conventional playing cards depicting heart suits, diamond suits, spade suits and club suits, with each suit including thirteen cards comprising ranks from two through ace, and a card rank and a number of pips matching the depicted card rank or a graphical representation corresponding to a face card rank, and five alternative cards each alternative card consisting of a suit, and logo or non-ranking letter, each of said alternative cards having no depicted card rank or graphical representation of a face card rank, wherein the alternative cards may take on multiple ranks selected from the ranks of the conventional cards the alternative cards replaced;

providing means for the player to hold or fold each of the five cards;

replacing any folded cards with new cards from cards remaining in the group of fifty-two cards; and providing a player a payout or award based on a strength of a final poker hand in combination with any alternative cards used to form said final poker hand.

14. The method of claim 13 further comprising awarding a bonus in response to a final poker hand having one or more alternative cards therein.

15. The method of claim 13 further comprising replacing the ten, jack, queen, king and ace of a common suit with the alternative cards.

16. The method of claim 13 further comprising incorporating a casino logo on the alternative cards.

17. The method of claim 13 facilitated by an electronic gaming machine.

18. The method of claim 13 facilitated by a live gaming table.

* * * * *